US005533213A

United States Patent [19]

Reiner et al.

[11] Patent Number: 5,533,213

[45] Date of Patent: Jul. 9, 1996

[54] BASEBALL CAP SIZING STRAP ATTACHMENT

[76] Inventors: Jay E. Reiner; Camille L. Reiner, both of 2002 NE. 120th Rd., N. Miami, Fla. 33181

[21] Appl. No.: 338,103

[22] Filed: Nov. 9, 1994

[51] Int. Cl.[6] ..... A42B 1/24

[52] U.S. Cl. ..... 2/195.2; 2/209.13; 40/329

[58] Field of Search ..... 2/195.2, 209.13, 2/171, 181, 181.2, 181.4, 181.6, 181.8, 195.1, 195.3, 195.4; 40/329

[56] References Cited

U.S. PATENT DOCUMENTS 5,003,640 4/1991 Pizzacar ..... 2/195.2
5,282,278 2/1994 Miner ..... 2/195
5,287,559 2/1994 Christiansen ..... 2/181
5,315,714 5/1994 Peters ..... 2/181.4

*Primary Examiner*—Diana Biefeld
*Attorney, Agent, or Firm*—Jacobson, Price, Holman & Stern

[57] ABSTRACT

A display attachment formed of a single planar piece of material, such as polyethylene, includes at least one aperture adjacent to its lowermost edge. The at least one aperture is sized such that at least one pin or projection of one portion of a sizing strap can extend through at least one aperture of the display attachment with the at least one projection extending through at least one of the openings on the other portion of a baseball style cap sizing strap so as to secure or engage the display attachment between the two portions of a baseball style cap sizing strap.

20 Claims, 2 Drawing Sheets

BASEBALL CAP SIZING STRAP ATTACHMENT

FIELD OF THE INVENTION

This invention relates to a display attachment for use with baseball style caps which can be used for the display of advertisements, logos, emblems, phrases, animated characters, illustrations, to list just a few exemplary uses of the baseball cap sizing strap display attachment of the present invention.

BACKGROUND OF THE INVENTION

Traditionally, baseball style caps have been used to display a team logo for various sports, including baseball, basketball, hockey and football. Recently, baseball style caps have been used to display the names of businesses and other advertising related indicia. These team logos and advertising indicia are located at the front of the crown of the cap above the visor.

To adjust the size of the cap so that a cap will fit a large variety of different sized heads, the caps include an adjustable sizing strap which can be made of two overlying strips of plastic, each anchored at one end to a rim or band extending around the lower periphery of the crown of the cap. One of the two straps includes a plurality of holes. The other of the two straps includes a plurality of projections which are sized to be pressed into and through the holes of the other strap so that the strap portion with the holes overlies the strap portion with the projections to complete the encircling of a rim or band about the lower periphery of the crown. A semi-circular opening in the crown located at the rear of the crown opposite to the visor provides play for adjusting the size of the cap at the sizing strap.

In view of a recent fad for children and young adults to wear baseball style caps with the visor of the cap pointing rearwardly, several products have been developed to include a team logo at the rear of the baseball style cap so that when the cap is reversed, the team logo will be displayed. Examples of such products are disclosed in U.S. Pat. No. 5,282,278 to Miner, U.S. Pat. No. 5,287,559 to Christiansen et al, and U.S. Pat. No. 5,315,714 to Peters et al. The products disclosed in these patents are all multi-layered and some include fasteners for securing the product to a cap.

SUMMARY OF THE INVENTION

By the present invention, a single planar piece of material, such as polyethylene, preferably includes at least one aperture including at least one hole, an oval opening, at least one slot or other engagement means adjacent to its lowermost edge. The apertures are sized such that the projections of one portion of a sizing strap can extend through the apertures of the display attachment of the present invention with the projections being fully capable of extending through the openings on the other portion of a baseball style cap sizing strap so as to lock the display attachment of the present invention between the two portions of a baseball style cap sizing strap. Alternatively, any other style cap, including a golf cap, may be used as long as the cap includes an adjustable sizing strap formed of two portions with interengaging projections and openings.

Also, the apertures in addition to being at least one hole or opening may be formed of at least one slot initiating at a lowermost edge of the display attachment and terminated spaced from the lowermost edge. The at least one slot would fit around the projections of the sizing strap to frictionally secure the display attachment to the projections and hold the display attachment in place between the two portions of the sizing strap.

The thickness of the single sheet of material forming the present invention is in the range of 0.018 to 0.022 inches, and preferably 0.022 inches. The thickness is such that it will not interfere with the securing of the two sizing strap portions together with the display attachment of the present invention secured between the two sizing strap portions. Alternatively, the display attachment of the present invention may have a three dimensional form at areas other than the portion secured between the two sizing strap portions.

Accordingly, it is considered as being within the scope of the present invention that adjacent to a lowermost edge of the attachment, will be formed one to seven apertures, and preferably five apertures, and in the instance where the aperture is a hole, the hole is of a diameter to allow passage of a projection from one portion of a sizing strap of a baseball style cap. Alternatively, the diameter of the at least one aperture may be equal to the diameter of the openings on the other portion of the sizing strap which receives the projections so as to securely engage the display attachment of the present invention on the projections on one portion of the sizing strap. The secure engagement of the display attachment may also be facilitated by having apertures formed as slots extending from a lowermost edge of the display attachment.

The display attachment includes a front face and a rear face. Both faces are imprintable. It is contemplated as a non-limiting example of the present invention that the front face of the attachment will include predetermined indicia which may include an illustration, a logo, an emblem, or any other printable subject matter. In addition, the rear face of the attachment is similarly imprintable for possibly including a legend about a character included on the front face of the attachment and any additional advertising desired, copyright notices, or information, as well as information or an illustration similar to that placed on the front face.

The material of the display attachment and the ink used for printing on one or both sides of the display attachment are non-toxic so that the product is "food contact reliable". It is envisioned that this display attachment could be distributed as a prize in cereal boxes, packaged with gum and/or baseball cards, or distributed with any other type of product with the display attachment producing no risk of contamination of a food or any other type of product.

Accordingly, it is an object of the present invention to provide a display attachment for securing to a sizing strap of an adjustable sized baseball style cap which is formed of a single integral piece of plastic which is secured between the two adjusting strap portions of the baseball style cap.

It is another object of the present invention to provide a display attachment for securing to a sizing strap of an adjustable sized baseball style cap which is formed of a single integral piece of plastic which is secured between the two adjusting strap portions of the baseball style cap with the projections of one portion of the sizing strap passing through at least one aperture in the display attachment and which continue to extend through openings in the other portion of the sizing strap for display of predetermined indicia at the rear of a crown of a baseball style cap.

It is yet another object of the present invention to provide a display attachment for securing to a sizing strap of an adjustable sized baseball style cap which is formed of a single integral piece of plastic which is secured between the two adjusting strap portions of the baseball style cap with the projections of one portion of the sizing strap passing through apertures in the display attachment and which continue to extend through openings in the other portion of the sizing strap for display of predetermined indicia at the rear of a crown of a baseball style cap which projects in front of a semi-circular opening at the rear of a crown of a baseball style cap.

It is still yet another object of the present invention to provide a display attachment for securing to a sizing strap of an adjustable sized baseball style cap which is formed of a single integral piece of plastic which is secured between the two adjusting strap portions of the baseball style cap with the projections of one portion of the sizing strap passing through apertures in the display attachment and which continue to extend through openings in the other portion of the sizing strap for display of predetermined indicia at the rear of a crown of a baseball style cap which projects in front of a semi-circular opening at the rear of a crown of a baseball style cap with the display attachment being imprintable upon a front face and a rear face with non-toxic inks.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
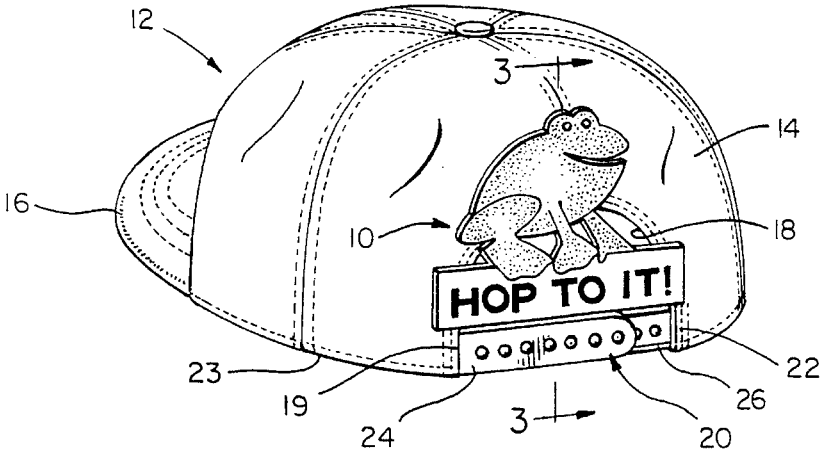
FIG. 1 is a perspective view of a display attachment of the present invention secured between two sizing strap portions of a baseball style cap.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
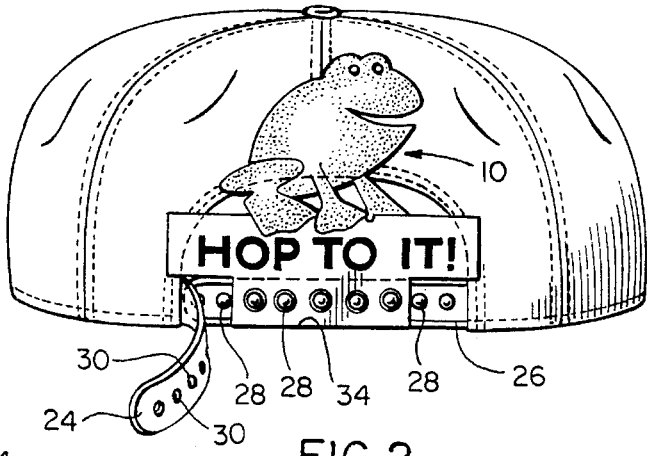
FIG. 2 illustrates one of the two portions of a sizing strap of a baseball style cap being moved away from interengagement with projections of the other portion of the sizing strap to reveal the display attachment of the present invention secured in position by projections of the other portion of the sizing strap.
Figure 3:
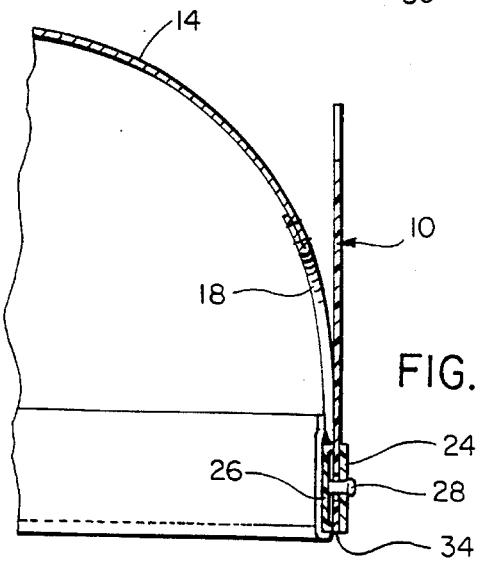
FIG. 3 is a cross-sectional view taken along line 3—3 of FIG. 1.

With reference to the drawings, in general, and to FIGS. 1 through 3, in particular, a display attachment embodying the teachings of the subject invention is generally designated as 10. With reference to its orientation in FIG. 1, the display attachment 10 is shown mounted upon a baseball style cap 12 having a crown 14 and a visor 16 located at a front of the cap 12. At a rear area of the cap 12 is located a semi-circular cut-out portion 18 having an adjustable sizing strap 20 spanning between opposite side edges 19, 22 of the opening 18 at a lowermost edge or rim 23 of the cap 12.

The sizing strap 20 includes a male portion 26 and a female portion 24. Male portion 26, as shown in FIG. 2, includes nine pins or projections 28 which extend across the portion 26 from one end of the strap portion 26 anchored at edge 22 towards an opposite free end of the strap portion 26.

The female portion 24 anchored at edge 19 includes seven openings 30 sized to engage with the projections 28 in a frictional interlocking fit. Due to the number of projections 28 passing through the openings 30 of strap portion 23, the size of the rim 24 of the cap 12 is adjustable to accommodate different sized heads.

Figure 4:
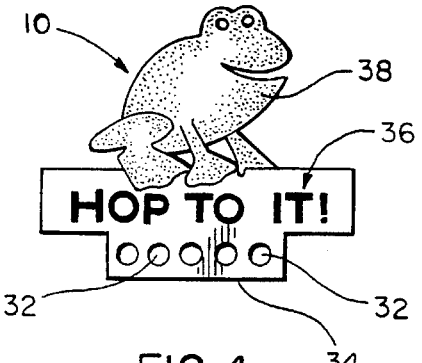
FIGS. 4 through 6 illustrate alternative embodiments of the display attachment of the present invention including predetermined indicia on a front face of the display attachment.

The display attachment 10 according to the embodiment shown in FIG. 4, includes five apertures formed by holes 32 located in a row positioned adjacent to a lowermost edge 34 of the attachment. Extending above the holes 32 is predetermined indicia which can take the form of many different shapes, slogans, expressions, illustrations, logos, etc. and be of varying thickness. In the exemplary embodiment shown in FIG. 4, a printed phrase 36 is displayed above the holes 32 and an illustration of an animal 38 projects above the phrase 36. This is but one example of the infinite arrangements of predetermined indicia which may be included on a display attachment 10 of the present invention. This would include having the display attachment cut into a predetermined shape indicative of some logo or product to be promoted.

In use, the display attachment is positioned such that the lowermost edge 34 of the display attachment 10 is aligned with lowermost edges of the strap portions 24 and 26. The holes 32 are of a size that they will fit over the projections 28 on the strap portion 26 in either a loose arrangement or in a frictionally gripping arrangement with the material of the display attachment being sufficiently flexible to pass over and around the projections 28 so as to be retained in place.

When the strap portion 24 is fitted over the strap portion 26 such that at least one of the projections 28, and preferably two, fit through at least one, and preferably two, of the openings 30 of the strap portion 24, the display attachment 10 is securely engaged in place between the two strap portions 24 and 26 as shown in FIG. 3. The display attachment will thereby project above the sizing strap 20 for display of the predetermined indicia. It is also contemplated as being within the scope of the present invention that the display attachment and its predetermined indicia may project below the sizing strap for display purposes.

Figure 5:
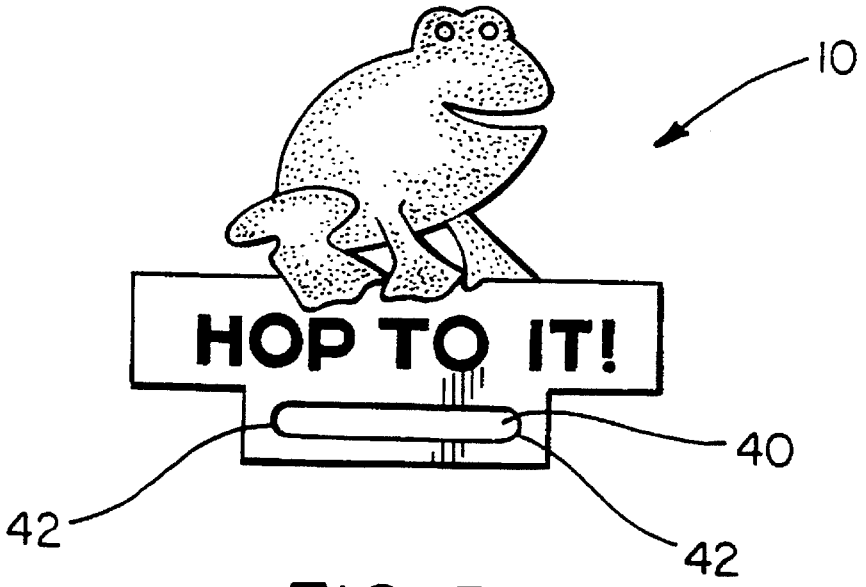

In FIG. 5, the aperture to hold the display attachment is in engagement between two overlapping portions of a sizing strap includes a single opening or slot 40. The opening 40 is elongated and includes curved terminal edges 42. At least one, and preferably at least two of pins or projections 28 fit through slot 40 to hold the display attachment between the overlapping portions of a sizing strap.

Figure 6:
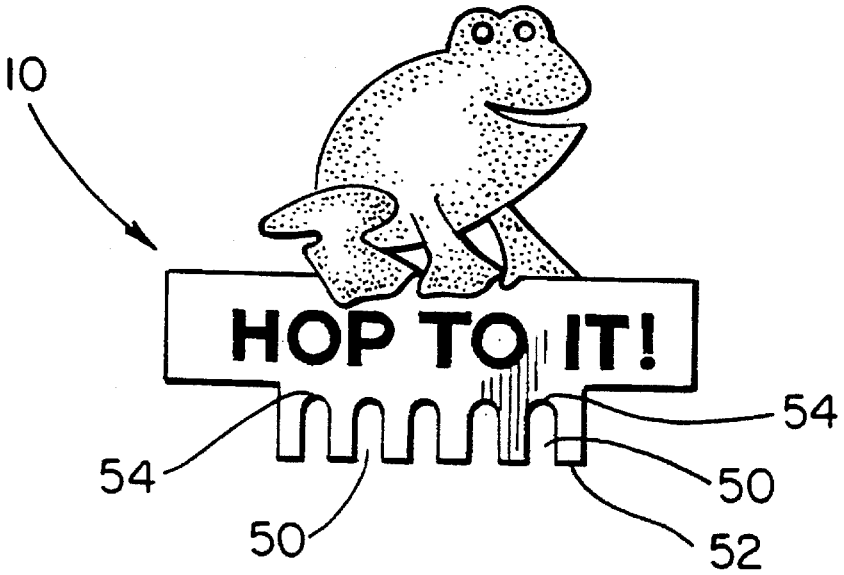

In FIG. 6, the display attachment 10 includes a plurality of apertures formed by slots 50 extending from lowermost edge 52 and terminating at curved edges 54. In this embodiment, at least one and preferably at least two pins or projections 28 are slid into the slots 50 and engaged by the sidewalls of the slots to secure the display attachment in place in a friction fit between the two overlapping portions of a sizing strap.

The single integral piece of material forming the display attachment of the present invention easily facilitates its use. The display attachment may be passed out at a sports event to show team support and solidarity or distributed with a breakfast food product or any other food product as an incentive to purchase a particular product. Its flat configuration and front and rear printing surfaces provide for an abundance of indicia to be provided with the display attachment cut either to a particular configuration by die-cutting or being of a continuous piece of material for increased area of printing by silkscreen or offset printing processes. The apertures formed of at least one hole, opening, slot, or other engaging means fixes the display attachment of the present invention between the two overlying portions of a sizing strap.

Having described the invention, many modifications thereto will become apparent to those skilled in the art to which it pertains without deviation from the spirit of the invention as defined by the scope of the appended claims.

We claim:

1. A display attachment and a cap, in combination, comprising:

predetermined indicia on said display attachment, and at least one aperture in said display attachment for fitting around at least one projection of one piece of a two piece sizing strap on said cap so that the other piece of said two piece sizing strap, having openings fitting around a corresponding number of said at least one projection, positions said display attachment, having a thickness, such that said display attachment is located between said one piece and said other piece of said two piece sizing strap and displays said predetermined indicia from said cap and said at least one projection of said one piece of said two piece sizing strap projects through said at least one aperture in said display attachment and then projects through said openings of said other piece of said two piece sizing strap to locate said display attachment between said one piece and said other piece of said two piece sizing strap.

2. A display attachment and a cap, in combination, according claim 1, wherein said display attachment is flat.

3. A display attachment and a cap, in combination, according to claim 1, wherein said predetermined indicia is printed with non-toxic ink.

4. A display attachment and a cap, in combination, according to claim 3, wherein said display attachment is made of a non-toxic material.

5. A display attachment and a cap, in combination, according to claim 1, wherein said predetermined indicia is located on a front face of said display attachment.

6. A display attachment and a cap, in combination, according to claim 1, wherein said at least one aperture includes five to seven holes.

7. A display attachment and a cap, in combination, according to claim 6, wherein said holes are located adjacent to a lowermost edge of said display attachment.

8. A display attachment and a cap, in combination, according to claim 7, wherein said holes are aligned in a row.

9. A display attachment and a cap, in combination, according to claim 1, wherein said at least one aperture includes an elongated slot.

10. A display attachment and a cap, in combination, according to claim 1, wherein said at least one aperture includes at least one slot.

11. A display attachment and a cap, in combination, according to claim 10, wherein said at least one slot extends from a lower most edge of said display attachment.

12. A display attachment and a cap, in combination, according to claim 10, wherein said at least one slot includes a plurality of slots.

13. In combination, a cap and a display attachment, said cap including a two piece sizing strap with one piece including a plurality of projections and the other piece including a plurality of openings, said display attachment including at least one aperture having a size greater than each of said plurality of projections and said at least one aperture fitting around at least one of said projections of said one piece and said other piece being secured to said one piece by said at least one of said projections passing first through said at least one aperture and then through said plurality of openings for securing said display attachment between said one piece and said other piece of said two piece sizing strap.

14. The combination according to claim 13, wherein said display attachment includes predetermined indicia.

15. The combination according to claim 14, wherein said predetermined indicia is located on a front face of said display attachment.

16. The combination according to claim 13, wherein at least one aperture includes five to seven holes.

17. The combination according to claim 16, wherein said holes are located adjacent to a lowermost edge of said display attachment.

18. The combination according to claim 13, wherein said at least one aperture includes at least one slot.

19. The combination according to claim 13, wherein said at least one aperture includes a plurality of slots.

20. The combination according to claim 13, wherein said at least one aperture includes a single elongated opening.

* * * * *